US009415278B2

(12) United States Patent
Kabeshita

(10) Patent No.: US 9,415,278 B2
(45) Date of Patent: Aug. 16, 2016

(54) RECONFIGURABLE GOLF BALL CONTAINER

(71) Applicant: NIKE, Inc., Beaverton, OR (US)

(72) Inventor: Yutaka Kabeshita, Portland, OR (US)

(73) Assignee: Nike, Inc., Beaverton, OR (US)

( * ) Notice: Subject to any disclaimer, the term of this patent is extended or adjusted under 35 U.S.C. 154(b) by 233 days.

(21) Appl. No.: 13/906,394

(22) Filed: May 31, 2013

(65) Prior Publication Data

US 2014/0353186 A1 Dec. 4, 2014

(51) Int. Cl.

| | |
|---|---|
| ***A63B 57/00*** | (2015.01) |
| ***A63B 47/00*** | (2006.01) |
| ***B65D 81/36*** | (2006.01) |

(52) U.S. Cl.

CPC ..... *A63B 47/00* (2013.01); *A63B 57/10* (2015.10); *B65D 81/36* (2013.01); *B65D 81/368* (2013.01); *A63B 2209/00* (2013.01)

(58) Field of Classification Search

CPC ..... A63B 47/00; A63B 57/0018; A63B 57/0012; A63B 57/0031; A63B 57/0037; A63B 2057/0025; B65D 81/36; B65D 81/363; B65D 81/365; B65D 81/368

See application file for complete search history.

(56) References Cited

U.S. PATENT DOCUMENTS

| | | | | |
|---|---|---|---|---|
| 4,887,817 | A * | 12/1989 | Pelc | 473/389 |
| 5,133,496 | A * | 7/1992 | Davidson et al. | 229/92.8 |
| 2001/0032794 | A1 | 10/2001 | Fushihara et al. | |
| 2001/0050241 | A1 | 12/2001 | Pratt et al. | |
| 2009/0032419 | A1 | 2/2009 | Kealy | |
| 2011/0168588 | A1 | 7/2011 | Guier | |

FOREIGN PATENT DOCUMENTS

JP 2000344284 A 12/2000

* cited by examiner

*Primary Examiner* — Andrew Perreault
(74) *Attorney, Agent, or Firm* — Quinn Law Group, PLLC

(57) ABSTRACT

A reconfigurable golf ball container includes a sleeve that is formed from a paperboard material and that defines an interior volume configured to hold a plurality of golf balls. The sleeve includes a perforated line disposed between a tool portion of the sleeve and a remainder of the sleeve. The tool portion of the sleeve is configured to be separated from the remainder of the sleeve along the perforated line to form a golf tool. The golf tool includes a first end configured to be inserted into a soil media, and includes a second end that is capable of supporting a golf ball more than 2.0 cm away from a surface of the soil media.

11 Claims, 3 Drawing Sheets

RECONFIGURABLE GOLF BALL CONTAINER

TECHNICAL FIELD

The present invention relates generally to a disposable golf ball container that is reconfigurable to operate as a golf tool.

BACKGROUND

Golf is a recreational game that involves repeatedly striking a ball with a club that is swung along an arcuate path. When the ball is struck by the club, the ball will typically become airborne to traverse a particular flight path/trajectory, and may have a particular spin rate. The game of golf is made up of generally 18 distinct holes, where a ball is initially struck within a tee-area for each respective hole, with the objective of locating the ball within an in-ground cup in the fewest ball-strikes (shots) possible.

During an initial shot for each hole, the golf ball may be raised upon a stand, called a "golf tee" to promote greater contact by a club. A typical golf tee may be made from wood or plastic, and may have a first end configured to be inserted within a soil media (i.e., the ground) and a second end configured to support a ball above the surface of the ground. Golf tees are generally consumable items that may be either broken or lost throughout the course of normal play. Because of their consumable nature, a golfer must be attentive to his or her supply of golf tees to avoid running out.

For an average golfer, a golf ball is also regarded as a consumable item that may be occasionally lost throughout normal play. It is customary for golf balls to be sold/packaged individually, in packages of 3 balls, and/or in packages of 12 balls. Typically 3 balls are boxed together in a paperboard "sleeve," and often 4 sleeves may be further packaged to form a larger box of 12 balls.

SUMMARY

A reconfigurable golf ball container includes a cuboid box configured to hold at least two golf balls. A golf tee blank is integrated within a portion of the box and is selectively removable from the box via a perforation partially disposed around the golf tee blank. The golf tee blank includes a first end configured to be inserted into a soil media, and includes a second end that is capable of supporting a golf ball more than 2.0 cm away from a surface of the soil media.

The golf tee blank may include a first face, a second face, and an edge disposed between the first face and the second face. The edge may extend between the first end and the second end, and may define an angle between the first face and the second face. The edge between the first face and the second face may be an edge of the cuboid box. The golf tee blank may include a point at the first end.

In one configuration, the second face may include a score line that is parallel to the edge. The score line may separate a proximal portion of the second face from a distal portion of the second face, where the proximal portion of the second face is disposed between the edge and the score line. The distal portion of the second face may be configured to be folded toward the first face to form a golf tee. In this configuration, the first face, the proximal portion of the second face, and the distal portion of the second face may form a substantially triangular cross section of the golf tee, and may cooperate to support the golf ball.

The cuboid box may be formed from a single sheet of paperboard material that is secured to itself to define a perimeter of the cuboid box. The single sheet of the paperboard material includes an edge of the sheet that may be disposed within the golf tee blank and parallel to the edge of the cuboid box.

In a similar manner, a reconfigurable golf ball container may include a sleeve that is formed from a paperboard material and that defines an interior volume configured to hold a plurality of golf balls. The sleeve includes a perforated line disposed between a tool portion of the sleeve and a remainder of the sleeve. The tool portion of the sleeve is configured to be separated from the remainder of the sleeve along the perforated line to form a golf tool. The golf tool includes a first end configured to be inserted into a soil media, and includes a second end that is capable of supporting a golf ball more than 2.0 cm away from a surface of the soil media.

Finally, a method of reconfiguring a golf ball sleeve as a golf tee may include separating a tool portion of a golf ball sleeve from a remainder of the sleeve to form a golf tee blank. The golf tee blank may have a first face, a second face, and an edge disposed between the first face and the second face. Once separated, the method may include folding a portion of the second face of the golf tee blank along a score line toward the first face to form a golf tee, where the score line is generally parallel to the edge. A first end of the golf tee may be inserted into a soil media, and a golf ball may be positioned on the second end of the golf tee.

In one configuration, separating a tool portion of a golf ball sleeve from a remainder of the sleeve includes tearing the sleeve along a perforated line that separates the tool portion from the remainder of the sleeve. Additionally, positioning a golf ball on the second end of the golf tee may include placing the golf ball in contact with the first face and with the second face on both sides of the fold line.

The above features and advantages and other features and advantages of the present invention are readily apparent from the following detailed description of the best modes for carrying out the invention when taken in connection with the accompanying drawings.

DETAILED DESCRIPTION

Figure 1:
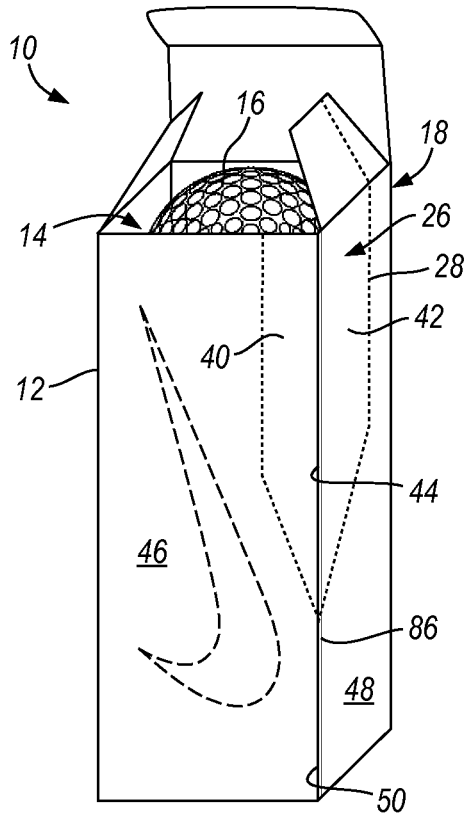
FIG. 1 is a schematic isometric view of a golf ball container that is reconfigurable as a golf tool.

Referring to the drawings, wherein like reference numerals are used to identify like or identical components in the various views, FIG. 1 schematically illustrates a reconfigurable golf ball container 10. This golf ball container 10 may be used in a traditional manner as a golf ball packaging sleeve 12 (i.e., a "sleeve 12"), and may define an interior volume 14 capable of holding a plurality of golf balls 16. In other embodiments, the present technology may relate to a box-like container that may hold a plurality of sleeves. With specific reference to FIG. 1, a sleeve 12 may generally have a cuboid shape that may be dimensioned to hold between 2 and 4 golf balls 16 in a stacked arrangement. As use herein, a cuboid is an elongated three-dimensional rectangular object that has a minimum of four edges of the same length (although in a more specific embodiment, the sleeve 12 may have eight edges of the same length). In one configuration, the sleeve 12 may be a box 18 formed, for example, from a paperboard material.

Figure 2:
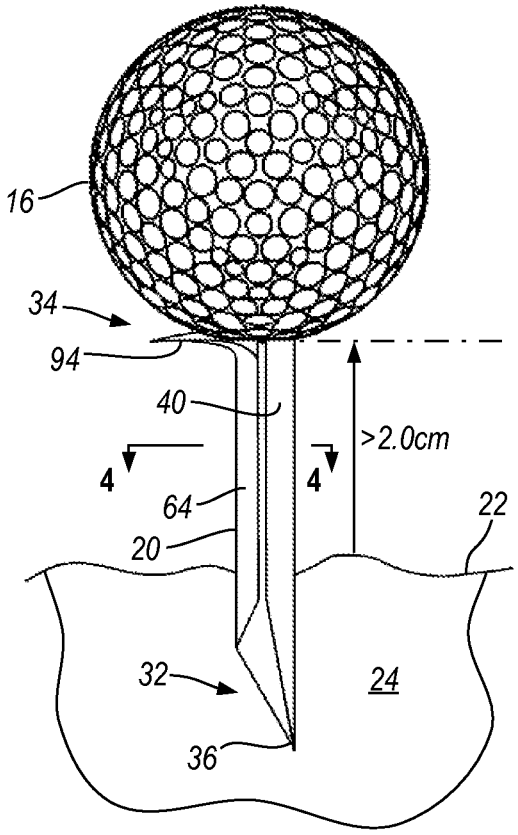
FIG. 2 is a schematic side view of a golf ball supported by a golf tee that was formed from a portion of a golf ball container.

The sleeve 12 may be selectively reconfigurable by a user to form one or more golf tools, which may assist the user while he or she is playing a game of golf. In some embodiments, the golf tool may include a divot repair tool, a groove cleaner tool for a golf club, or a ball marker tool for marking a user's ball on a putting green. In another embodiment, the golf tool may be a golf tee 20, such as shown in FIG. 2, which may be capable of supporting a golf ball 16 more than 2.0 cm above a surface 22 of a soil media 24 (i.e., the ground).

Referring again to FIG. 1, the sleeve 12 may include an integrated golf tee blank 26 that is partially defined by a perforated line 28 disposed about the blank 26. The perforated line 28 may be a weakened portion of the box 18 that may promote separation of the blank 26 from the box 18 via tearing along the line 28. The perforated line 28 may be formed in any manner that is customary within the art, and may include, for example, a plurality of individual perforations that each extend partially or completely through the thickness of the box 18.

Figure 3:
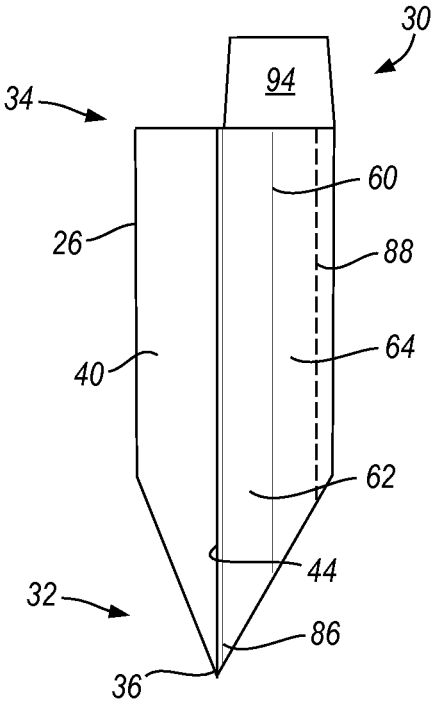
FIG. 3 is a schematic plan view of a golf tee blank.

FIG. 3 illustrates an enlarged, flattened side view 30 of the golf tee blank 26, after it is separated from the box 18. The golf tee blank 26 generally includes a first end portion 32 that is configured to be inserted into the soil media 24, and a second end portion 34 that is capable of supporting a golf ball 16. In one configuration, the first end portion 32 may generally form a point 36 that may aid the first end portion 32 in piercing and extending into the soil media 24. While FIG. 3 illustrates the point 36 as being a sharp point resembling an acute angle, in other configurations, the point may be rounded, bull nosed, trapezoidal, or may be formed from an angle that is a right angle or an obtuse angle.

Referring again to FIG. 1, the golf tee blank 26 may include a first face 40 and a second face 42 that are separated by an edge 44. As shown, the first face 40 may be a portion of a first side 46 of the cuboid box 18 and the second face 42 may be a portion of a second side 48 of the cuboid box 18. In this manner, the edge 44 of the golf tee blank 26 may also be a portion of an edge 50 of the cuboid box 18, and the first face 40 of the blank 26 may generally be maintained at a right angle to the second face 42 of the blank 26 when the blank 26 is integrated with the box 18.

As shown in FIG. 3, the edge 44 may generally extend between the first end portion 32 and the second end portion 34, and more specifically between the point 36 and the second end portion 34. In this manner, the edge 44 may add rigidity to the point 36, as compared with a point that may be on a planar surface.

As further illustrated in FIG. 3, a score line 60 may be provided within the second face 42. The score line 60 generally separates a proximal portion 62 of the second face 42 from a distal portion 64 of the second face ("proximal" and "distal" being relative to the edge 44), with the proximal portion 62 being disposed between the score line 60 and the edge 44. The score line 60 may generally be a thinned, compressed, or pre-creased portion of the second face 42 that may promote bending along the line 60. In one configuration, the score line 60 may be parallel to the edge 44. In another configuration, the score line may be oriented within 30 degrees of parallel, preferably with one end of the score line 60 originating at or near the point 36.

Figure 4:
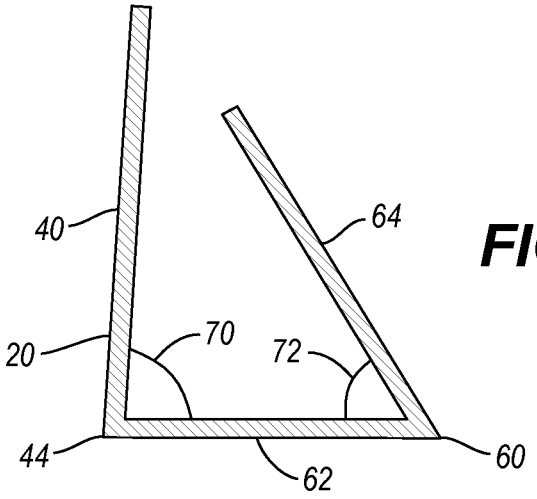
FIG. 4 is a schematic cross-sectional view of the golf tee of FIG. 2, taken along line 4-4.

FIG. 4 illustrates a cross-sectional view (not to scale) of a golf tee 20, such as taken along line 4-4 of FIG. 2. As shown, the distal portion 64 of the second face 42 may be folded along the score line 60 in a direction towards the first face 40. In this manner, the angle 70 between the first face 40 and the proximal portion 62 of the second face 42 may be approximately 90 degrees, though may be bent to an acute, or slightly obtuse angle. When the distal portion 64 of the second face 42 is folded toward the first face 40 to form the tee 20, the distal portion 64 of the second face 42 may form an acute angle 72 with the proximal portion 62 of the second face 42. As such, the first face 40, the proximal portion 62 of the second face 42, and the distal portion 64 of the second face 42 may generally form a triangle. It should be appreciated that the triangle need not be a closed triangle, as the distal portion 64 of the second face 42 need not touch the first face 40. When a ball 16 is placed on the tee 20, the ball 16 may contact each of the first face 40, the distal portion 64 of the second face 42, and the proximal portion 62 of the second face 42. As such, the ball 16 may be supported by at least three points of contact, and may be discouraged from freely rolling off the tee 20.

Figure 5:
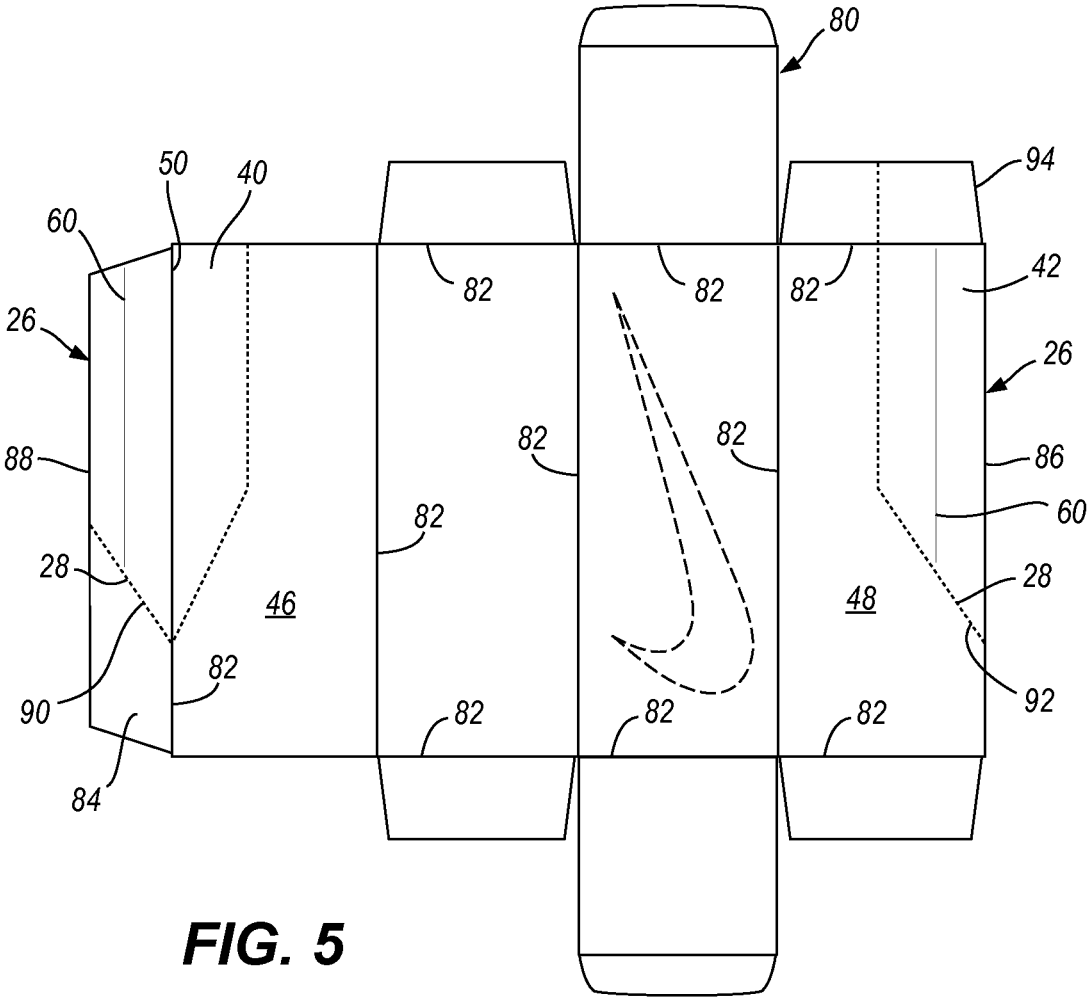
FIG. 5 is a schematic top view of a paperboard sheet that may be formed into a reconfigurable golf ball container.

FIG. 5 illustrates a pre-assembled paperboard sheet 80 that may be formed into the box 18. As shown, the sheet 80 may include a plurality of fold lines 82 that may be scored or pre-creased to form the various edges of the box 18. As shown, the first side 46 of the box may be on a substantially opposite side of the sheet 80 from the second side 48. Moreover, a securing tab 84 may be coupled with the first side 46 to aid in the construction of the box 18. In one configuration, the edge 50 between the securing tab 84 and the first face 46 may be the edge 50 that runs the length of the golf tee blank 26.

Referring again to FIGS. 1 and 3, the second side 48 of the cuboid box 18 may be fastened to the securing tab 84 such that an edge 86 of the paperboard sheet 80 is disposed adjacent to the edge 50 of the box 18. In one configuration, the edge 86 of the sheet 80 may be within 1.0 cm of the edge 50 of the box 18, and may be substantially disposed within the proximal portion 62 of the second face 42 of the blank 26. FIG. 3 further illustrates in phantom, the outer edge 88 of the securing tab 84. In one configuration, the second side 48 of the box 18 may be glued to the securing tab 84 to define a rectangular perimeter of the box 18. The use of a double-thickness portion within the golf tee 20 may enhance the rigidity of the tee, and aid it in penetrating the soil media, as well as in supporting the golf ball 16.

As further shown in FIG. 5, the perforated line 28 may include a first portion 90 and a second portion 92 that are disposed at opposite sides of the paperboard sheet 80, with the first and second portions 90, 92, not being connected, except when overlaid during construction of the box 18.

Referring again to FIG. 1, in one configuration, the perforated line 28 may extend through a side flap 94 of the box 18. When the tee 20 is formed, such as shown in FIG. 2, the flap 94 may generally extend outward from the tee 20, and may be operative to contact the ball 16 and/or provide additional stability or support to the ball 16.

Figure 6:
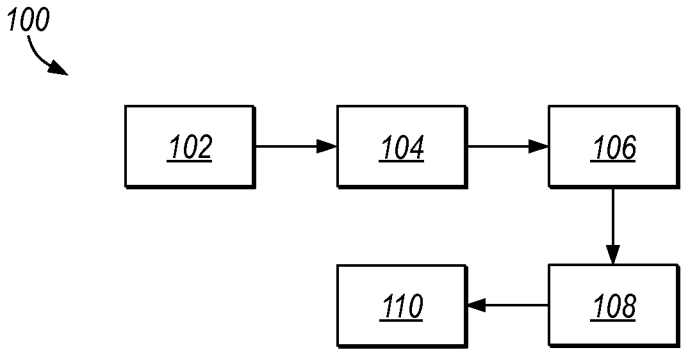
FIG. 6 is a schematic flow diagram of a method of reconfiguring a golf ball sleeve as a golf tee.

Finally, FIG. 6 provides a schematic flow diagram of a method 100 of reconfiguring a golf ball sleeve 12 as a golf tee 20. The method 100 begins at 102 when a golfer wishes to utilize a temporary golf tee 20 that is integrated into an otherwise disposable golf sleeve 12. At 104 a tool portion of the golf ball sleeve 12 is separated from a remainder of the sleeve 12 to form a golf tee blank 26. In the manner described above, the golf tee blank 26 may include a first face 40, a second face 42, and an edge 44 disposed between the first face 40 and the second face 42.

At 106, a portion (i.e., the distal portion 64) of the second face 42 of the golf tee blank 26 may be folded along a score line 60 toward the first face 40 to form a golf tee 20. In one configuration, the score line 60 may be generally parallel to the edge 44. At 108, a first end portion 32 of the golf tee 20 may be inserted into a soil media 24 (i.e., the ground); and at 110, a golf ball 16 may be positioned on the second end portion 34 of the golf tee 20. The golf tee 20 may be capable of supporting the golf ball 16 more than 2.0 cm away from a surface of the soil media 24.

In one configuration, separating a tool portion of a golf ball sleeve 12 from a remainder of the sleeve 12 includes tearing the sleeve 12 along a perforated line 28 that separates the tool portion from the remainder of the sleeve 12. Additionally, positioning a golf ball 16 on the second end 34 of the golf tee 20 includes placing the golf ball 16 in contact with the first face 40 and with the second face 42 on both sides of the fold/score line 60.

While the best modes for carrying out the invention have been described in detail, those familiar with the art to which this invention relates will recognize various alternative designs and embodiments for practicing the invention within the scope of the appended claims. It is intended that all matter contained in the above description or shown in the accompanying drawings shall be interpreted as illustrative only and not as limiting.

The invention claimed is:

1. A reconfigurable golf ball container comprising:

a cuboid box having a first portion, a second portion, and a perforation disposed between the first portion and the second portion, wherein the box defines an interior volume that is operative to to hold at least two golf balls therein;

wherein the first portion of the box is a golf tee blank that is selectively removable from the box via the perforation, and wherein the golf tee blank comprises:

a first face, a second face, and an edge disposed between the first face and the second face;

wherein the edge extends between a first end of the golf tee blank and a second end of the golf tee blank to define an edge of the cuboid box;

wherein the first end of the golf tee blank comprises a point; wherein the second face includes a score line parallel to the edge, and wherein the score line is a thinned, compressed, or pre-creased portion of the second face; and wherein the score line separates a proximal portion of the second face from a distant portion of the second face, the proximal portion of the second face being disposed between the edge and the score line.

2. The container of claim 1, wherein the golf tee blank is operative to support one of the at least two golf balls at the second end when:

the golf tee blank is separated from the second portion of the cuboid box along the perforation;

the distal portion of the second face is folded toward the first face along the score line; and the first end is inserted into a soil medium.

3. The container of claim 2, wherein supporting one of the at least two golf balls includes balancing the golf ball on a substantially triangular cross section defined by the first face, the proximal portion of the second face, and the distal portion of the second face.

4. The container of claim 1, wherein the cuboid box comprises a paperboard material.

5. The container of claim 4, wherein the cuboid box comprises a single sheet of the paperboard material that is secured to itself to define a perimeter of the cuboid box.

6. The container of claim 5, wherein the single sheet of the paperboard material includes an edge of the sheet;

wherein the edge of the sheet is at least partially disposed within the first portion of the box and parallel to the edge of the cuboid box.

7. The container of claim 1, wherein the cuboid box further comprises a side flap, and wherein the perforation extends through the side flap.

8. The container of claim 6, wherein the edge of the sheet is within 1.0 cm of the edge of the golf tee blank.

9. The container of claim 1, wherein the cuboid box comprises a single sheet of the paperboard material that is secured to itself to define a perimeter of the cuboid box;

wherein the single sheet of the paperboard material includes an edge of the sheet that is at least partially disposed within the proximal portion of the second face and parallel to the edge of the golf tee blank.

10. The container of claim 1, wherein the edge of the golf tee blank has a length that is greater than 2.0 cm.

11. The container of claim 1, wherein the point is coincident with the edge of the golf tee blank.

* * * * *